US010048642B2

(12) United States Patent
Hashimoto

(10) Patent No.: US 10,048,642 B2
(45) Date of Patent: Aug. 14, 2018

(54) IMAGE FORMING APPARATUS AND PAPER FEED DEVICE

(71) Applicant: Sharp Kabushiki Kaisha, Osaka (JP)

(72) Inventor: Susumu Hashimoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 15/290,044

(22) Filed: Oct. 11, 2016

(65) Prior Publication Data

US 2017/0108818 A1 Apr. 20, 2017

(30) Foreign Application Priority Data

Oct. 14, 2015 (JP) ..... 2015-203183
Aug. 2, 2016 (JP) ..... 2016-151876

(51) Int. Cl.
*G03G 15/00* (2006.01)
*G03G 21/16* (2006.01)

(52) U.S. Cl.
CPC ..... *G03G 21/1619* (2013.01); *G03G 21/1609* (2013.01); *G03G 21/1647* (2013.01)

(58) Field of Classification Search
CPC ..... G03G 21/1619; G03G 21/1647
See application file for complete search history.

(56) References Cited

U.S. PATENT DOCUMENTS

2004/0264998 A1* 12/2004 Uchida ..... G03G 15/6511 399/107

FOREIGN PATENT DOCUMENTS

JP 2002-217561 8/2002
JP 2002-258562 9/2002

* cited by examiner

*Primary Examiner* — Hoang Ngo
(74) *Attorney, Agent, or Firm* — Renner Otto Boisselle & Sklar, LLP

(57) ABSTRACT

An image forming unit and a paper feed unit on which the image forming unit is stacked is provided. The image forming unit or the paper feed unit includes a connecting fixing member including a connection portion with which the units are connected to and fixed to each other. The connecting fixing member is rotatably provided to one device which is one of the image forming unit and the paper feed unit. The connection portion rotates to an engagement position of the other device, when the connecting fixing member comes into contact with the other device which is the other one of the image forming unit and the paper feed unit.

12 Claims, 17 Drawing Sheets

IMAGE FORMING APPARATUS AND PAPER FEED DEVICE

CROSS-REFERENCE TO RELATED APPLICATIONS

The present application claims the benefit of priority under Section 119(a) of 35 U.S.C. on Japanese Patent Application No. 2015-203183 filed on Oct. 14, 2015, and Japanese Patent Application No. 2016-151876 filed on Aug. 2, 2016, the entirety of which is incorporated herein by reference.

BACKGROUND ART

Field of the Invention

The present invention relates to an image forming apparatus and a paper feed device.

Description of the Related Art

Conventionally used image forming apparatuses include a combination of a paper feed unit, capable of storing paper of a large amount of and a plurality of types, and an image forming unit. With this configuration, the paper to be used can be appropriately selected. Such an image forming apparatus employs a structure in which the image forming unit is mounted on the paper feed unit to save space. For example, Japanese Unexamined Patent Application Publication No. 2002-258562 (hereinafter, referred to as Patent Literature 1) and Japanese Unexamined Patent Application Publication No. 2002-217561 (hereinafter, referred to as Patent Literature 2) each propose a connecting fixing structure with which the paper feed unit and the image forming unit can be easily positioned and a stability of the apparatus can be achieved.

Unfortunately, the connecting fixing structure proposed in Patent Literatures 1 and 2 requires a complex positioning pin and locking structure. The positioning pin and the locking structure are positioned in the apparatus. Thus, an operator needs access inside of the apparatus to release the connecting and fixing, and thus a work efficiency is low. When the structure where the connecting and fixing is released from the outside is employed, a releasing structure, as well as the locking structure, is required. This means that the number of parts is increased and an attempt to reduce the size of the apparatus is hindered.

In view of the above, the following simple structure has also been proposed. More specifically, a connection plate is rotatably attached to a portion around an outer circumference of the paper feed unit. After the image forming unit has been mounted, the operator pulls up the connection plate to a connection position with his or her hand, and then fastens a screw in a position of a fixing hole while holding the connection plate.

In this structure, the operator has to perform the fastening work with the screw while holding the connection plate. Thus, a sufficient work space might not be available depending on the attached position of the connection plate, the installed position of the apparatus, and a work environment around the apparatus. Thus, improvement of the workability has been desired.

The present invention is made in view of the conventional problem described above, and an object of the present invention is to provide an image forming apparatus in which a paper feed unit and an image forming unit can be connected and fixed to each other with a simple structure, and the connecting and the fixing can be achieved with higher workability.

SUMMARY OF THE INVENTION

An image forming apparatus according to the present invention for achieving the object includes: a first device; and a second device stacked on the first device. The first device or the second device includes a connecting fixing member including a connection portion with which the devices are connected and fixed to each other. The connecting fixing member is rotatably provided to one device which is one of the first device and the second device. The connection portion of the connecting fixing member rotates to a connection position when the connecting fixing member comes into contact with another device which is another one of the first device and the second device.

In this image forming apparatus according to the present invention, the connection portion of the connecting fixing member rotates to the connection position when the connecting fixing member provided to the one device comes into contact with the other device. Thus, an operator does not have to pull up the connecting fixing member or hold the connecting fixing member at the engagement position. Thus, the connecting and fixing can be achieved with a simple structure and with higher workability.

In an embodiment of the present invention, the connecting fixing member may include a contact portion that comes into contact with the other device when the first device is connected to the second device. When the contact portion is in a state of not being in contact with the other device, the contact portion may be at a position of protruding in a direction from the one device toward the other device, and the connection portion may be at a position of not protruding in the direction from the one device toward the other device.

In an embodiment of the present invention, the connection portion may be provided with a hole in which a fastening member is inserted.

In an embodiment of the present invention, the connection portion may rotate to the connection position so as to be connected to a connected portion provided to the other device.

In an embodiment of the present invention, the connecting fixing member may include a main body part. The connection portion may be provided to the main body part in such a manner as to be rotatable in a direction of the rotation between the connection position to be connected with the connected portion and a release position where the connection with the connected portion is released.

In an embodiment of the present invention, the connecting fixing member may include a restricting portion with which a position of the connection portion is restricted at the connection position and at the release position.

In an embodiment of the present invention, the connection portion may include an operated portion used for causing rotation between the connection position and the release position.

In an embodiment of the present invention, the connected portion may be a connection pin, and the connection portion may be a connection lever to be connected with the connection pin.

In an embodiment of the present invention, in the connecting fixing member, a step may be formed between the contact portion and the connection portion.

In an embodiment of the present invention, the first device or the second device may include a second connecting fixing member including a connection portion with which the devices are connected and fixed to each other. The second connecting fixing member may be rotatably provided to the one device that is one of the first device and the second device, and the connection portion may rotate to the connection position of the other device when the second connecting fixing member rotates.

In an embodiment of the present invention, the one device may be the second device, the other device may be the first device, and the first device may be placed on and connected to the second device.

A paper feed device according to the present invention for achieving the object is configured to feed paper to an image forming unit mounted on the paper feed device, and includes connecting fixing member including a connection portion with which the image forming unit is connected and fixed. The connecting fixing member is rotatably provided, and the connection portion rotates to a connection position of the image forming unit when the connecting fixing member comes into contact with the image forming unit.

In this paper feed device according to the present invention, the connection portion rotates to the connection position when the connecting fixing member provided to the paper feed device comes into contact with the image forming unit. Thus, the operator does not have to pull up the connecting fixing member or hold the connecting fixing member at the engagement position. Thus, the connecting and fixing can be achieved with a simple structure and with higher workability.

With the present invention, an image forming apparatus and a paper feed device can be provided in which the paper feed unit and an image forming unit can be connected to and fixed to each other with a simple structure, and the connecting and fixing can be achieved with higher workability.

DESCRIPTION OF THE EMBODIMENTS

First Embodiment

Figure 1:
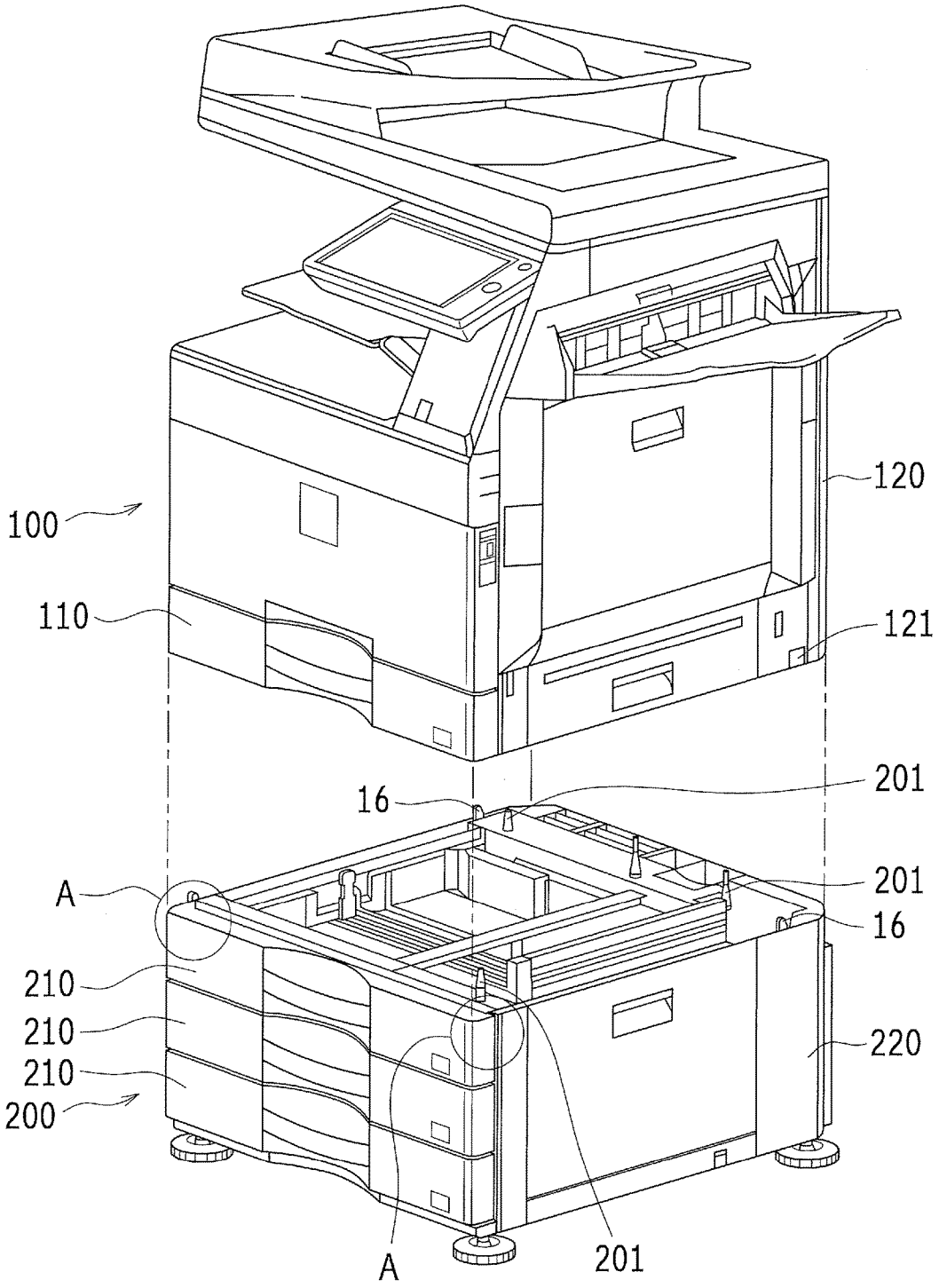
FIG. 1 is a schematic perspective view illustrating a state where an image forming unit and a paper feed desk are separated from each other, representing a state before the image forming unit is mounted on the paper feed desk.

A first embodiment of the present invention is described with reference to the drawings. FIG. 1 is a schematic perspective view of an image forming apparatus to which the present invention is applied. The image forming apparatus includes an image forming unit 100 and a paper feed desk (paper feed unit) 200. The image forming unit 100 is placed and fixed while being positioned with positioning pins 201 of the paper feed desk 200. FIG. 1 is a schematic perspective view illustrating a state where the image forming unit 100 and the paper feed desk 200 are separated from each other, representing a state before the image forming unit 100 is mounted on the paper feed desk 200.

The image forming unit 100 is a main body part of the image forming apparatus and is in charge of forming an image on paper. More specifically, a multicolor or monochrome image is formed on predetermined paper in accordance with an image of a document read by the image reading device or image data received from the outside. The image forming unit 100 includes a single paper feed cassette 110 that is disposed in a lower portion, stores a single type of paper, and feeds the paper to the image forming unit 100. The device mounted on the paper feed desk 200 may include devices other than the image forming unit 100 including the paper feed cassette 110. More specifically, a document read unit that reads the document image, a platen on which a document is placed, an automatic-document feeder, and the like may also be provided.

The image forming unit 100 includes an exposing unit, a development unit, a photosensitive drum, a cleaning unit, a charging unit, an intermediate transfer belt unit, a fixing unit, and a secondary transfer unit. The image data processed in this image forming apparatus corresponds to a color image using colors black (K), cyan (C), magenta (M), and yellow (Y). Thus, four development units, four photosensitive drums, four charging units, and four cleaning units are provided for forming four types of latent images respectively corresponding to the colors, are respectively set for the colors black, cyan, magenta, and yellow, and form four image stations.

The paper feed desk 200 is a paper feed device including a plurality of paper feed cassettes 210 that store a plurality of types of paper, and feed the paper to the image forming unit 100. The paper feed desk 200 has an upper surface provided with the plurality of positioning pins 201 at positions corresponding to a plurality positioning holes (not illustrated) formed on the image forming unit 100 that is mounted on the paper feed desk 200. In this example, the positioning holes and the positioning pins 201 are provided at total of four positions including three on a rear side (right side in FIG. 1) of the image forming apparatus and one at a right edge on a front side (left side in FIG. 1). However, the number of holes and pins and their positions are not limited to those described above, and may be set as appropriate.

Figure 2:
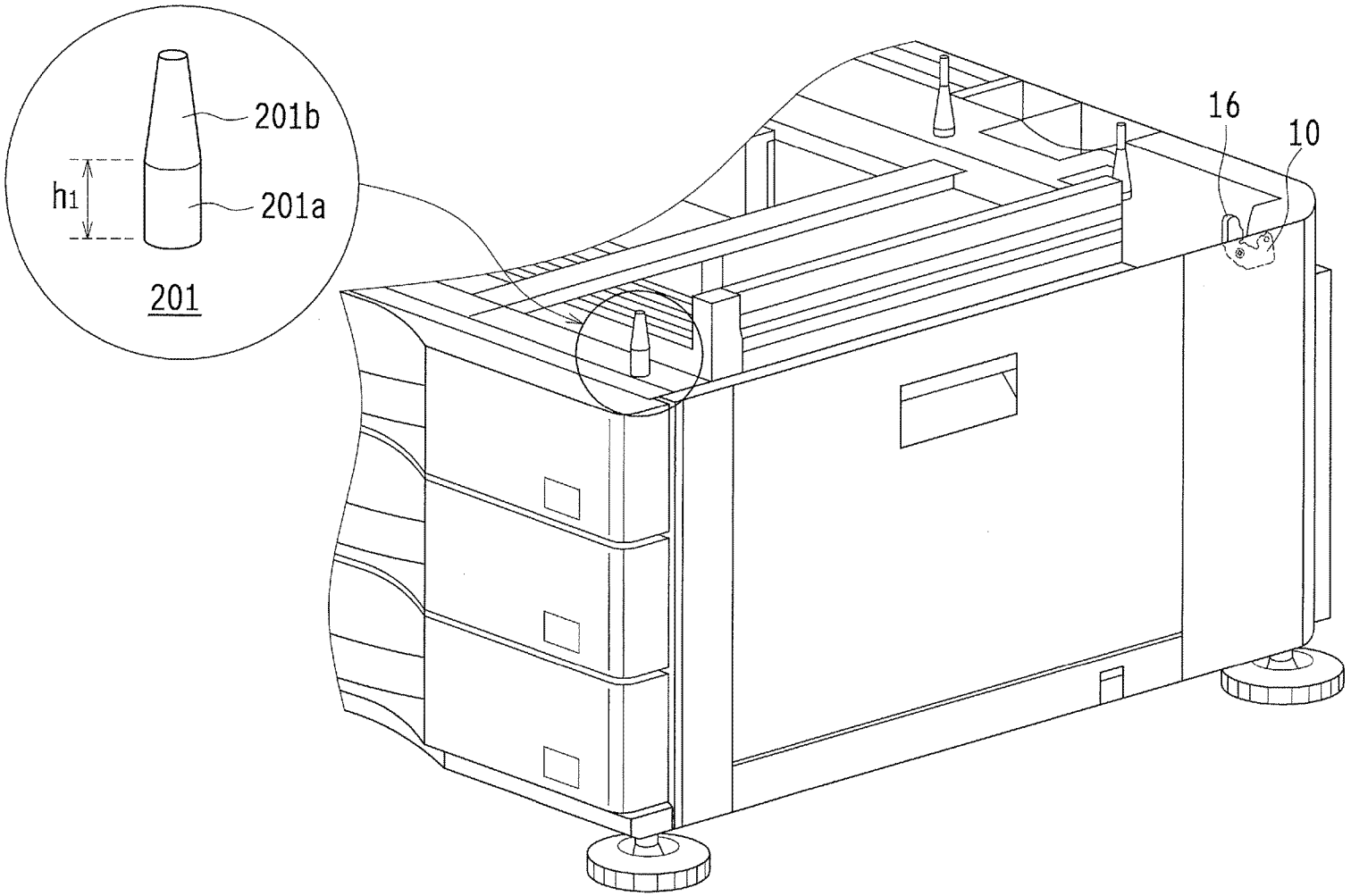
FIG. 2 is a schematic enlarged view illustrating a positioning pin.

FIG. 2 is an enlarged schematic view illustrating the positioning pin 201. As illustrated in the figure, the positioning pin 201 is a protruding member standing on a surface (mounting surface) of the paper feed desk 200 on which the image forming unit 100 is mounted. The positioning pin 201 has an approximately column shape defined by a lower portion 201*a* and an upper portion 201*b*. The lower portion 201*a* has an approximately cylindrical shape and approximately vertically stands from the mounting surface. The upper portion 201*b* has an approximately truncated cone shape and is continuously and integrally formed on the lower portion 201*a*. The lower portion 201*a* has a height h1 that is approximately the same as a protruding height of a connecting fixing member described later. The lower portion 201*a* has a diameter that is approximately the same as an inner diameter of the positioning hole of the image forming unit 100. The upper portion 201*b* has the approximately truncated cone shape with the diameter reducing as it gets far from the lower portion 201*a*, and thus has a tip portion with a smaller diameter than the positioning hole.

When the image forming unit 100 is mounted on the paper feed desk 200, the image forming unit 100 is moved in a horizontal direction so that the plurality of positioning pins 201 respectively face the positioning holes, and then the image forming unit 100 is lowered. The upper portion 201*b* of the positioning pin 201 has the approximately truncated cone shape in a tapering form, and thus the pins and the holes may be misaligned as long as the misaligned amount is within a range of the diameter of the positioning hole. When the image forming unit 100 is lowered after the positioning pins 201 and the positioning holes are positioned with each other, the pins are inserted in the positioning hole from the upper portions 201*b*. When the distance between the image forming unit 100 and the paper feed desk 200 is reduced to be smaller than the height h1 described above, the lower portion 201*a* reaches the positioning hole, whereby accurate positioning can be achieved.

Figure 3:
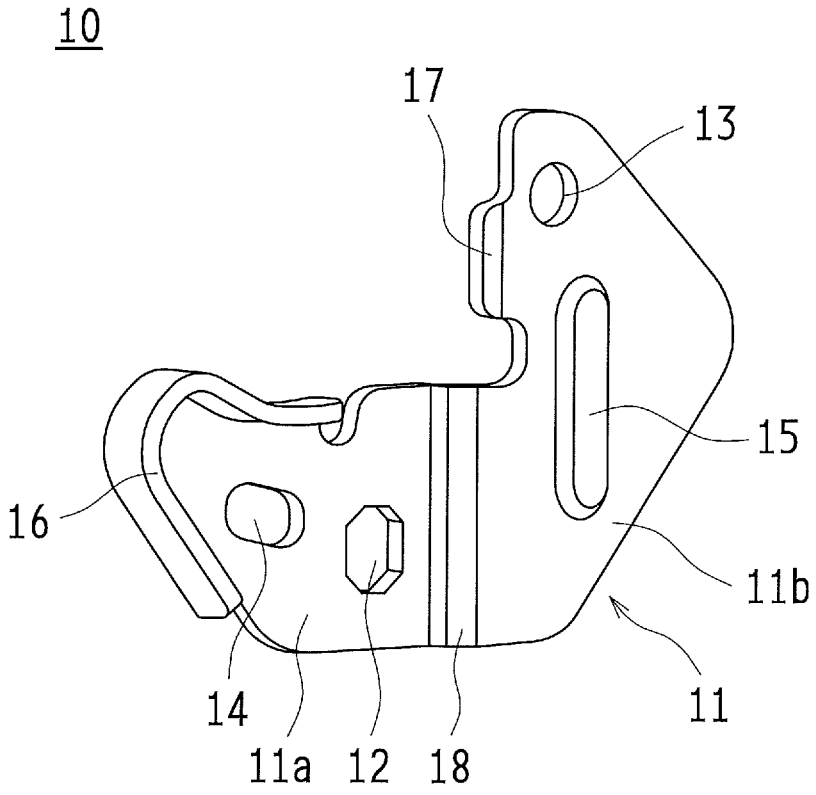
FIG. 3 is a schematic perspective view illustrating a connecting fixing member according to a first embodiment.

FIG. 3 is a schematic perspective view illustrating the connecting fixing member 10 in the image forming apparatus according to the present invention. The connecting fixing member 10 is rotatably attached to a portion of the paper feed desk 200 near an outer circumference, and is used for connecting and fixing the image forming unit 100 and the paper feed desk 200 to each other. As illustrated in FIG. 1, in the first embodiment, the connecting fixing member 10 is attached to each of two positions respectively on both left and right side surfaces of a desk casing 220 of the paper feed desk 200 close to a rear side. In the first embodiment, second connecting fixing members 40 are provided in addition to the connecting fixing members 10. The second connecting fixing member 40 is rotatably attached to each of positions (A portions circled in FIG. 1) of the casing front surface on a front side of the desk casing 220 that are exposed when the topmost one of the paper feed cassettes 210 is pulled out. This will be described later in detail. The connecting fixing members 10 are first described.

The connecting fixing member 10 is formed by punching a fulcrum hole 12, a fastening hole 13, and balance adjustment holes 14 and 15 through a plate portion 11 having an approximately flat plate shape, and by forming a contact portion 16, a guide portion 17, and a step portion 18 by bending the plate portion 11, and has an approximately J shaped outer shape. The connecting fixing member 10 is preferably made of a metal material, and may be made of a material other than metal as long as desired strength and workability can be ensured.

The plate portion 11 can be divided by the step portion 18 into an attachment surface 11*a* and a separated surface 11*b*. The attachment surface 11*a* is an area where the fulcrum hole 12 is formed and is at a position close to the paper feed desk 200. The separated surface 11*b* is an area where the fastening hole 13 is formed, and is at a position farther from the paper feed desk 200 compared with the attachment surface. The outer shape of the plate portion 11 is not limited to that illustrated in FIG. 3, but it is required that a virtual line connecting among the contact portion 16, the fulcrum hole 12, and the fastening hole 13 be in a V shape.

The fulcrum hole 12 is used for attaching the connecting fixing member 10 to the paper feed desk 200 with a shoulder screw. The connecting fixing member 10 is attached with the shoulder screw screwed in a screw hole at a corresponding position of the paper feed desk 200, and thus is attached to the paper feed desk 200 in such a manner as to be rotatable about the shoulder screw.

The fastening hole 13 is used for fixing the connecting fixing member 10 with a fixing screw (not illustrated) screwed in a fixing hole 23 (see FIG. 4) formed in the image forming unit 100 as described later, and corresponds to an engagement portion in the present invention. The connecting fixing member 10 is accurately positioned to be mounted on the paper feed desk 200, and is rotated in such a manner that the fastening hole 13 moves to the engagement position corresponding to the fixing hole 23 formed in the image forming unit 100.

The balance adjustment holes 14 and 15 are holes formed for reducing the weight without compromising the strength and the size of the connecting fixing member 10. With the balance adjustment holes 14 and 15 thus formed, the centroid position and the balance of the connecting fixing member 10 that rotates about the fulcrum hole 12 can be adjusted. Thus, the arrangement of the connecting fixing member 10 before and after the contact with the image forming unit 100 can be determined.

The contact portion 16 is formed by bending one tip of the plate portion 11 to be in a direction approximately orthogonal to a direction of plane of the plate portion 11, and is processed to be in a curved surface having an outer shape similar to that of the tip of the plate portion 11. The guide portion 17 is a tapered portion that is bent by a predetermined angle from the plate portion 11 toward the side opposite to the paper feed desk 200, and is disposed closer to the image forming unit 100 compared with the fastening hole 13, in the configuration where the rotation occurs about the fulcrum hole 12.

The step portion 18 is a step with a crank shape and is provided between the area of the plate portion 11 where the fulcrum hole 12 is formed and the area of the plate portion 11 where the fastening hole 13 is formed. With the step portion 18 thus formed, a level difference is provided between the attachment surface 11*a* and the separated surface 11*b* so that a predetermined distance can be ensured between the separated surface 11*b* and the paper feed desk 200.

Figure 4:
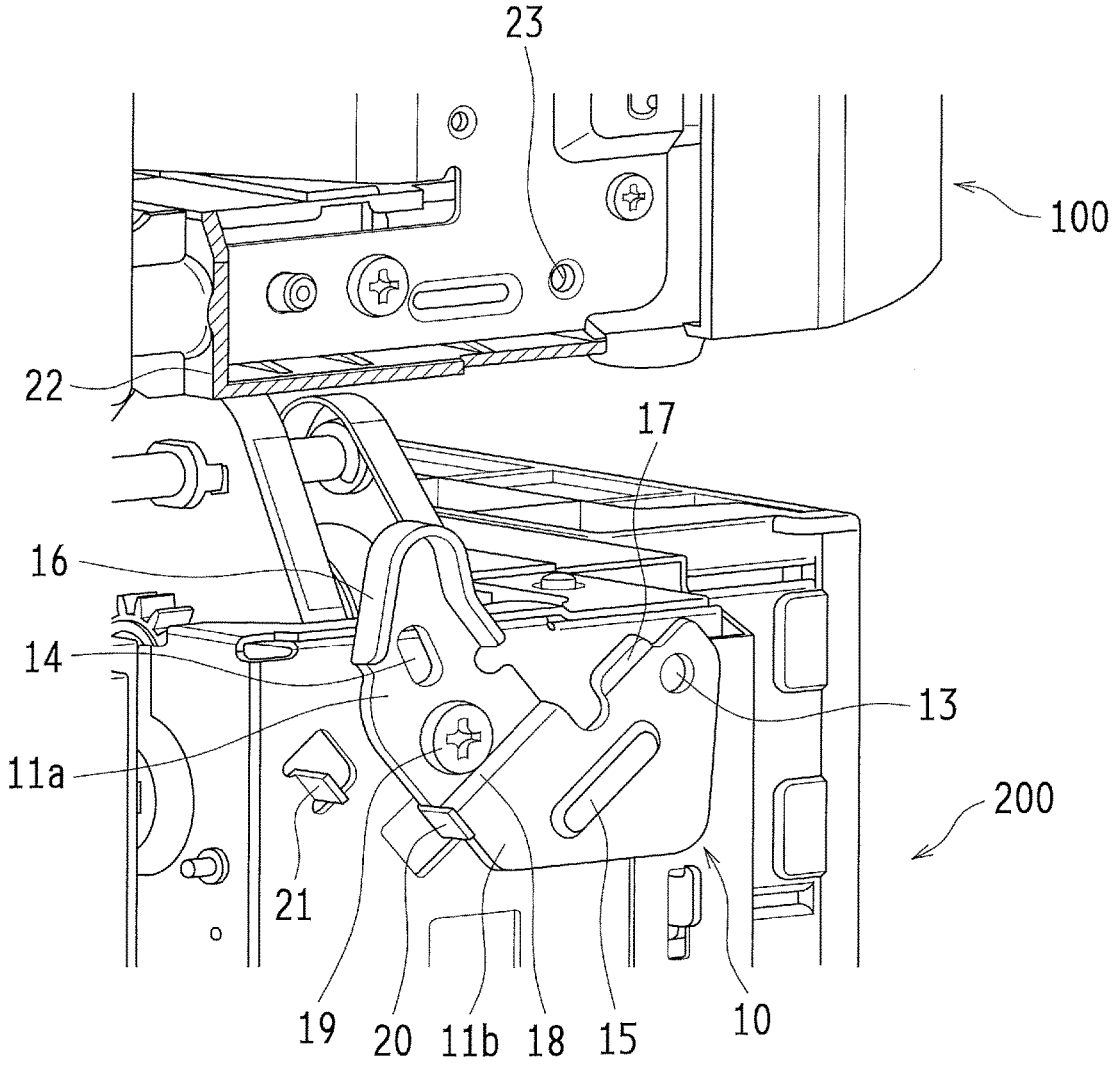
FIG. 4 is a schematic enlarged perspective view illustrating a state where the image forming unit is positioned on the paper feed desk, representing a state before the image forming unit is mounted on the paper feed desk.

FIG. 4 is a schematic enlarged perspective view illustrating a state where the image forming unit 100 is positioned on the paper feed desk 200, representing a state before the image forming unit 100 is mounted on the paper feed desk 200. The connecting fixing member 10 is attached with the shoulder screw 19 used for the fulcrum hole 12 aligned with a position of a screw hole (not illustrated) formed at a position of the paper feed desk 200 around an upper portion of the side surface. The paper feed desk 200 has a side surface provided with stoppers 20 and 21. An interference portion 22 is formed on a bottom surface of the image forming unit 100. A fixing hole 23 is formed at a portion of the image forming unit 100 around a lower portion of the side surface.

The stoppers 20 and 21 are formed by partially bending a plate forming the side surface of the paper feed desk 200 to stand in a lateral direction, and have a height large enough to interfere with the connecting fixing member 10 attached to the side surface. As illustrated in FIG. 4, the stopper 20 interferes with the connecting fixing member 10 in the state before the image forming unit 100 is mounted on the paper feed desk 200, and thus restricts the rotation of the connecting fixing member 10. The stopper 21 is formed at such a position as to interfere with the connecting fixing member 10 in the state where the image forming unit 100 is mounted on the paper feed desk 200, and thus restrict the rotation of the connecting fixing member 10.

The interference portion 22 is a part of a member forming the bottom surface of the image forming unit 100, and protrudes beyond the side surface of the paper feed desk 200 to a corresponding position to interfere with the contact portion 16 of the connecting fixing member 10 attached to the side surface of the paper feed desk 200. When the side surface of the image forming unit 100 and the side surface of the paper feed desk 200 are approximately flush surfaces with respect to a lateral direction, the interference portion 22 protrudes from the side surface of the image forming unit 100. When the side surface of the image forming unit 100 is positioned more on the outer side than the side surface of the paper feed desk 200, the interference portion 22 may be a part of the bottom surface of the image forming unit 100.

The fixing hole 23 is formed on the side surface of the image forming unit 100 and has as a screw thread formed on its inner portion. The fixing hole 23 is formed at a position overlapped by the fastening hole 13 of the connecting fixing member 10 in the state where the image forming unit 100 is mounted on the paper feed desk 200.

As illustrated in FIG. 4, the connecting fixing member 10 is attached to the side surface of the paper feed desk 200 with the shoulder screw 19 in the state before the image forming unit 100 is mounted on the paper feed desk 200. In this state, the connecting fixing member 10, rotatable about the shoulder screw 19 and the fulcrum hole 12, has the attachment surface 11*a* disposed on an upper side and the separated surface 11*b* disposed on a lower side, due to the weight balance of the connecting fixing member 10. The stopper 20 is interfering with the connecting fixing member 10 to prevent the rotation of the connecting fixing member 10. In this state, the contact portion 16 at the tip of the attachment surface 11*a* protrudes beyond the upper surface of the paper feed desk 200, with a protruding height h2 (see FIG. 5). The separated surface 11*b* is positioned below the upper surface of the paper feed desk 200. The fastening hole 13 and the guide portion 17 do not protrude from the upper surface of the paper feed desk 200, and thus are also positioned below the upper surface.

Figure 5:
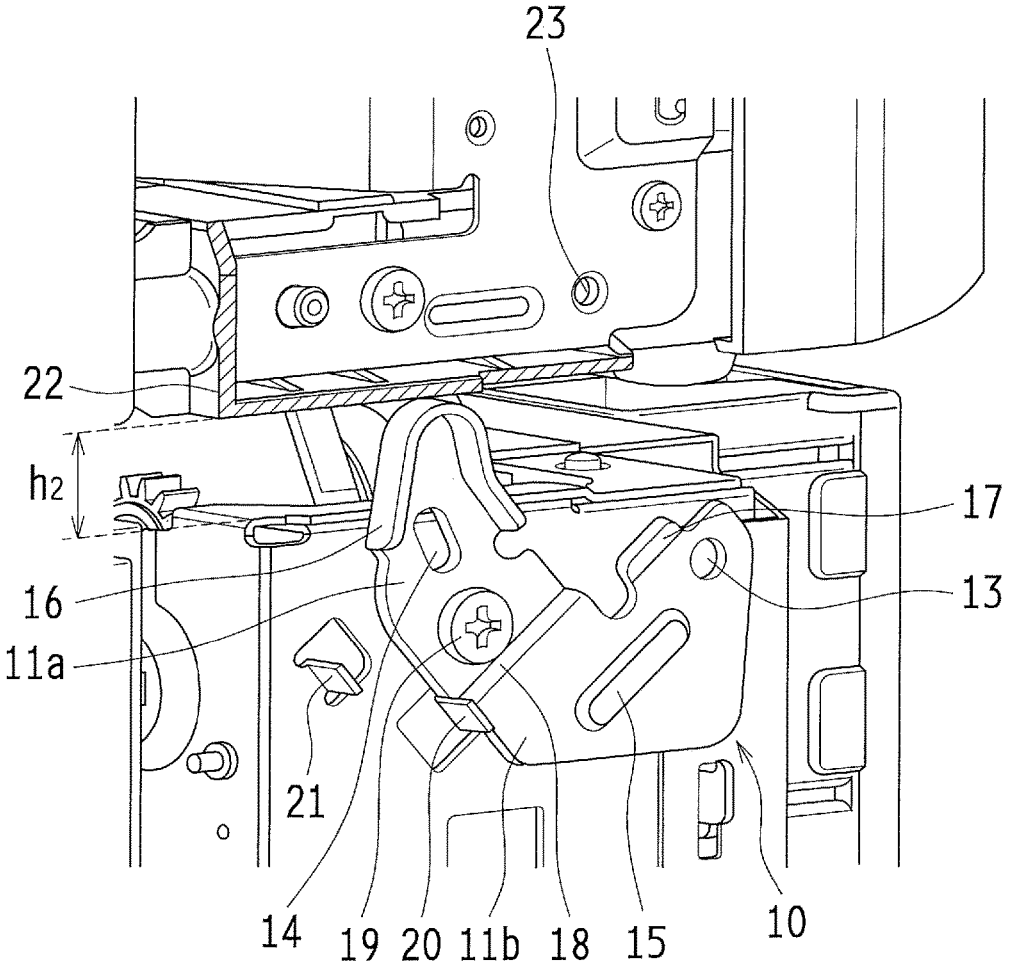
FIG. 5 is a schematic enlarged perspective view illustrating a state where the image forming unit is positioned and lowered on the paper feed desk so that a contact portion comes into contact with an interference portion.

FIG. 5 is a schematic enlarged perspective view illustrating a state where the image forming unit 100 is positioned and lowered on the paper feed desk 200 so that the contact portion 16 comes into contact with the interference portion 22. As illustrated in the figure, the contact portion 16 comes into contact with the interference portion 22, when the distance h2 is achieved between the bottom surface of the image forming unit 100 and the upper surface of the paper feed desk 200. When the image forming unit 100 is further lowered after the distance h2 is achieved, the contact portion 16 is pressed down in a direction not restricted by the stopper 20. Thus, the attachment surface 11*a* and the separated surface 11*b* of the connecting fixing member 10 rotate about the shoulder screw 19 downward and upward respectively.

The distance between the bottom surface of the image forming unit 100 and the upper surface of the paper feed desk 200 at the point when the contact portion 16 comes into contact with the interference portion 22 is approximately the same as the height h2 of the portion of the contact portion 16 protruding beyond the upper surface of the paper feed desk 200. The height h1 of the lower portion 201*a* of the positioning pin 201 and the protruding height h2 of the contact portion 16 are preferably set in such a manner that $h1 \geq h2$ holds true, so that when the image forming unit 100 is positioned and lowered, the contact portion 16 comes into contact with the interference portion 22, after the lower portion 201*a* of the positioning pin 201 reaches the positioning hole.

The diameters of the lower portion 201*a* of the positioning pin 201 and the positioning hole are set to be approximately the same. Thus, when $h1 \geq h2$ holds true, the connecting fixing member 10 starts rotating with the contact portion 16 pressed down, after the image forming unit 100 is accurately positioned. This means that the connecting fixing member 10 does not rotate until the image forming unit 100 is accurately positioned. All things considered, the separated surface 11*b* is prevented from moving upward beyond the upper surface of the paper feed desk 200 to collide with the image forming unit 100.

Figure 6:
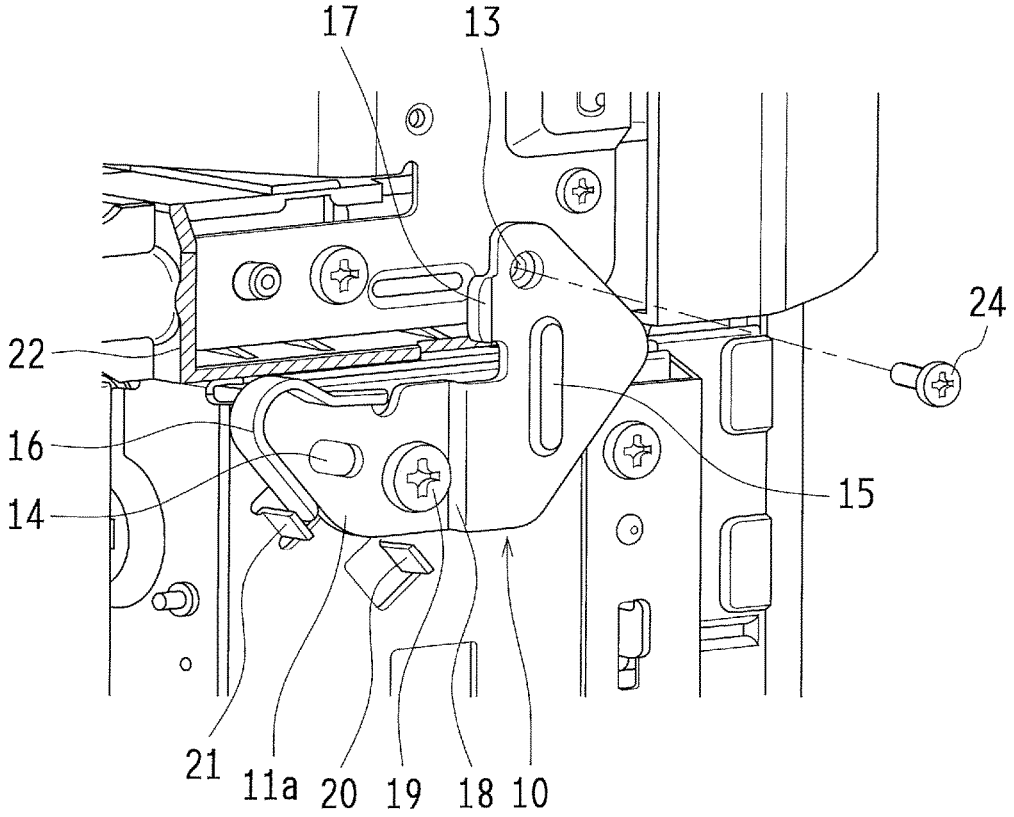
FIG. 6 is a schematic enlarged perspective view illustrating a state where the image forming unit is placed on the paper feed desk.

FIG. 6 is a schematic enlarged perspective view illustrating the state where the image forming unit 100 is placed on the paper feed desk 200. In the state where the image forming unit 100 is placed on the paper feed desk 200, the contact portion 16 has been pressed down by the interference portion 22, and thus the attachment surface 11*a* has been rotated to be below the upper surface of the paper feed desk 200. In this process, the connecting fixing member 10 is rotated about the fulcrum hole 12 and the shoulder screw 19, whereby the guide portion 17 and the fastening hole 13 of the separated surface 11*b* are positioned above the upper surface of the paper feed desk 200. The stopper 21 is for restricting the connecting fixing member 10 from excessively rotating, and is not for positioning the connecting fixing member 10. Thus, the stopper 21 needs not to be in contact with the connecting fixing member 10, and may be separated from the connecting fixing member 10 by a predetermined distance.

When the image forming unit 100 is lifted from the paper feed desk 200 in the state illustrated in FIG. 6, the attachment surface 11*a* and the separated surface 11*b* of the connecting fixing member 10 rotate due to the weight balance to restore the state illustrated in FIG. 4. Specifically, the attachment surface 11*a* rotates upward to be positioned above the upper surface of the paper feed desk 200. The separated surface 11*b* rotates downward to be positioned below the upper surface of the paper feed desk 200.

The connecting fixing member 10 rotates about the fulcrum hole 12 and the shoulder screw 19. Thus, the guide portion 17 is a part of the separated surface 11*b* to be first raised above the upper surface of the paper feed desk 200. The guide portion 17 is bent toward the side opposite to the paper feed desk 200. Thus, even when the image forming unit 100 interferes with the separated surface 11*b*, fine adjustment is achieved along the tapered shape within a degree of freedom provided by the shoulder screw 19.

Figure 7:
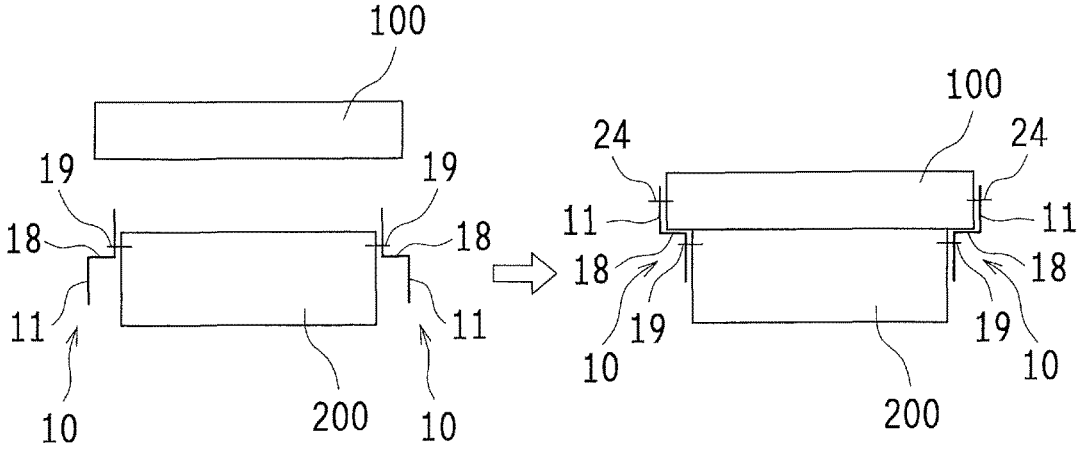
FIG. 7 is a schematic view illustrating a connecting fixing operation in a case where the image forming unit is wider than the paper feed desk.

FIG. 7 is a schematic view illustrating a connecting fixing operation in a case where the image forming unit 100 is wider than the paper feed desk 200. FIG. 7 focuses on describing the function of the step portion 18 of the connecting fixing member 10, and thus the structure of the members is simplified in the figure.

When the image forming unit 100 is wider than the paper feed desk 200, the level difference between the attachment surface 11*a* and the separated surface 11*b* due to the step portion 18 of the connecting fixing member 10 is set to conform with the width of the image forming unit 100. As illustrated in a left section in FIG. 7, the connecting fixing members 10 are rotatably attached to the side surfaces of the paper feed desk 200 with the shoulder screws 19 before the image forming unit 100 is placed on the paper feed desk 200. As described above, when the image forming unit 100 is placed on the paper feed desk 200, the connecting fixing member 10 rotates. With the level difference provided by the step portion 18 in the connecting fixing member 10, the separated surface 11*b* can be positioned more on the outer side than the side surface of the image forming unit 100.

As illustrated in FIG. 6, when the image forming unit 100 is placed on the paper feed desk 200, the contact portion 16 is pressed down by the interference portion 22, and thus the connecting fixing member 10 is rotated, so that the fastening hole 13 and the fixing hole 23 are positioned at the engagement position while being overlapped with each other. In this state, a fixing screw 24 is screwed into the fixing hole 23 through the fastening hole 13, whereby the connecting fixing member 10 is fixed to the side surface of the image forming unit 100. As described above, the fastening hole 13 and the fixing hole 23 are overlapped with each other. Thus, an operator can perform an operation with the fixing screw 24 and a tool in his or her hands without holding the connecting fixing member 10, whereby higher workability can be achieved.

Figure 8:
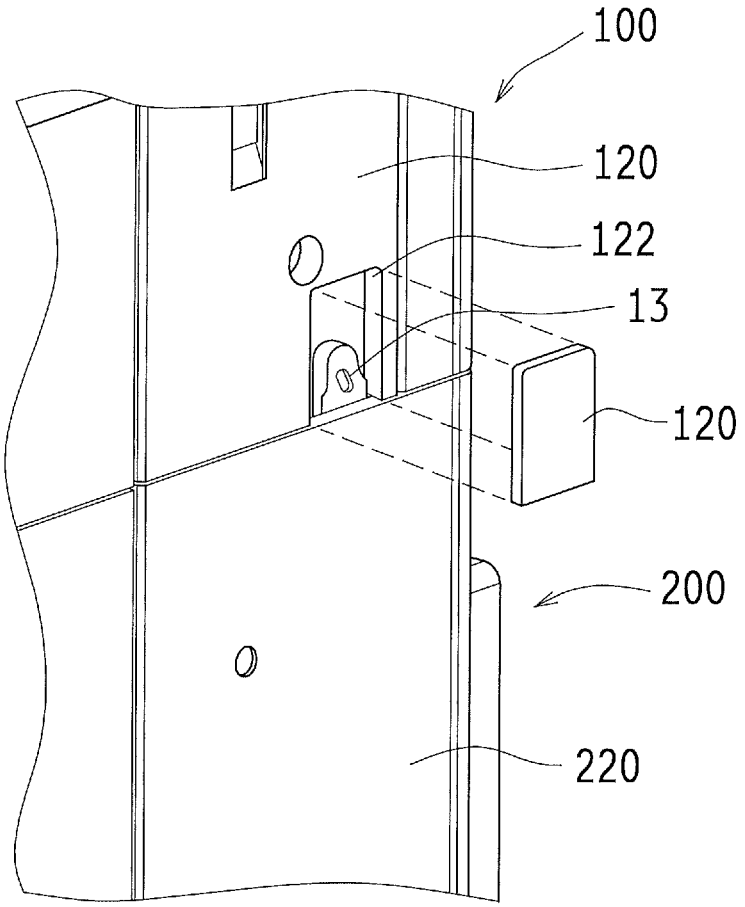
FIG. 8 is a schematic perspective view illustrating a main portion before an opening/closing cover is attached.
Figure 9:
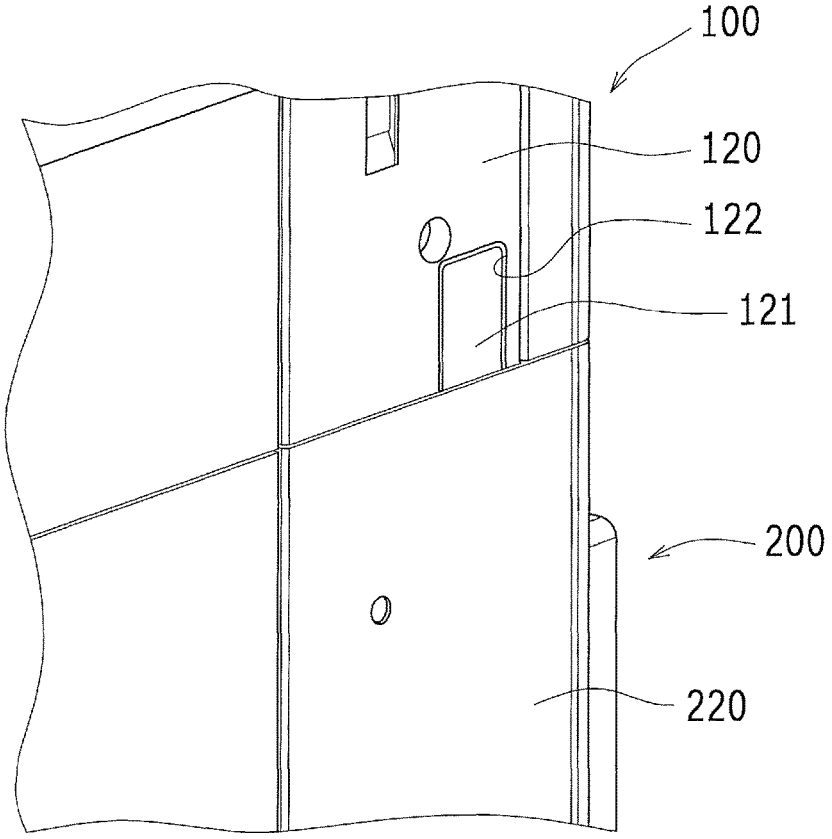
FIG. 9 is a schematic perspective view illustrating the main portion in a state where the opening/closing cover is attached.

In this case, as illustrated in FIGS. 1, 8, and 9, an opening/closing cover 121 is attached to a portion of a side surface of a casing 120 accommodating the image forming unit 100 facing the fixing hole 23 (that is, a position facing the fastening hole 13 of the connecting fixing member 10 at the engagement position). When the opening/closing cover 121 is opened (removed), the portion where the fixing hole 23 and the fastening hole 13 of the connecting fixing member 10 overlaps each other can be visually recognized from the outside through a cover opening portion 122 of the casing 120. Thus, in the state where the opening/closing cover 121 is removed, the fixing screw 24 is screwed into the fixing hole 23 through the fastening hole 13 so that the connecting fixing member 10 is fixed to the side surface of the image forming unit 100. Then, the opening/closing cover 121 is reattached to the cover opening portion 122 of the casing 120, and thus the fastener portion of the connecting fixing member 10 can be covered. Various conventionally known attaching structures may be employed for a structure of detachably attaching the opening/closing cover 121 to the cover opening portion 122. In one example of such a structure, a craw is provided to the opening/closing cover 121 and elastically engages with a circumference edge portion of the cover opening portion 122. Alternatively, the attaching structure may not be provided. Thus, a structure where the opening/closing cover 121 is simply fixed with a fixing screw or the like, an attaching structure as a combination of the engaging claw and the fixing screw, or the like may be employed.

The connecting fixing member 10 is rotatably attached to the side surface of the paper feed desk 200 with the shoulder screw 19, and is fixed to the side surface of the image forming unit 100 with the fixing screw 24. In the image forming apparatus, the positioning pins 201 are inserted in the positioning holes. Thus, the movement of the image forming unit 100 on the paper feed desk 200 is restricted in both the horizontal and the vertical directions, whereby the paper feed desk 200 and the image forming unit 100 can be connected and fixed to each other with a simple structure.

FIG. 6 illustrates only a single side surface of the image forming apparatus. It is to be noted that the connecting and fixing can be achieved with the movement of the image forming unit 100 in the vertical and the horizontal directions more effectively restricted, when the fixing is performed on two or more side surfaces adjacent to each other by using the connecting fixing members 10 that are the same or similar to the one described above. In the described example, the fixing screw 24 is fastened to the fixing hole 23 with the fastening hole 13 serving as the engagement portion. Alternatively, other mechanical fixing unit may be used as the engagement portion.

In the first embodiment, the second connecting fixing member 40 is rotatably attached to each of two left and right portions (the A portions circled in FIG. 1) on the casing front surface that is on the front side of the desk casing 220 and are exposed when the topmost one of the paper feed cassettes 210 is pulled out.

Figure 10:
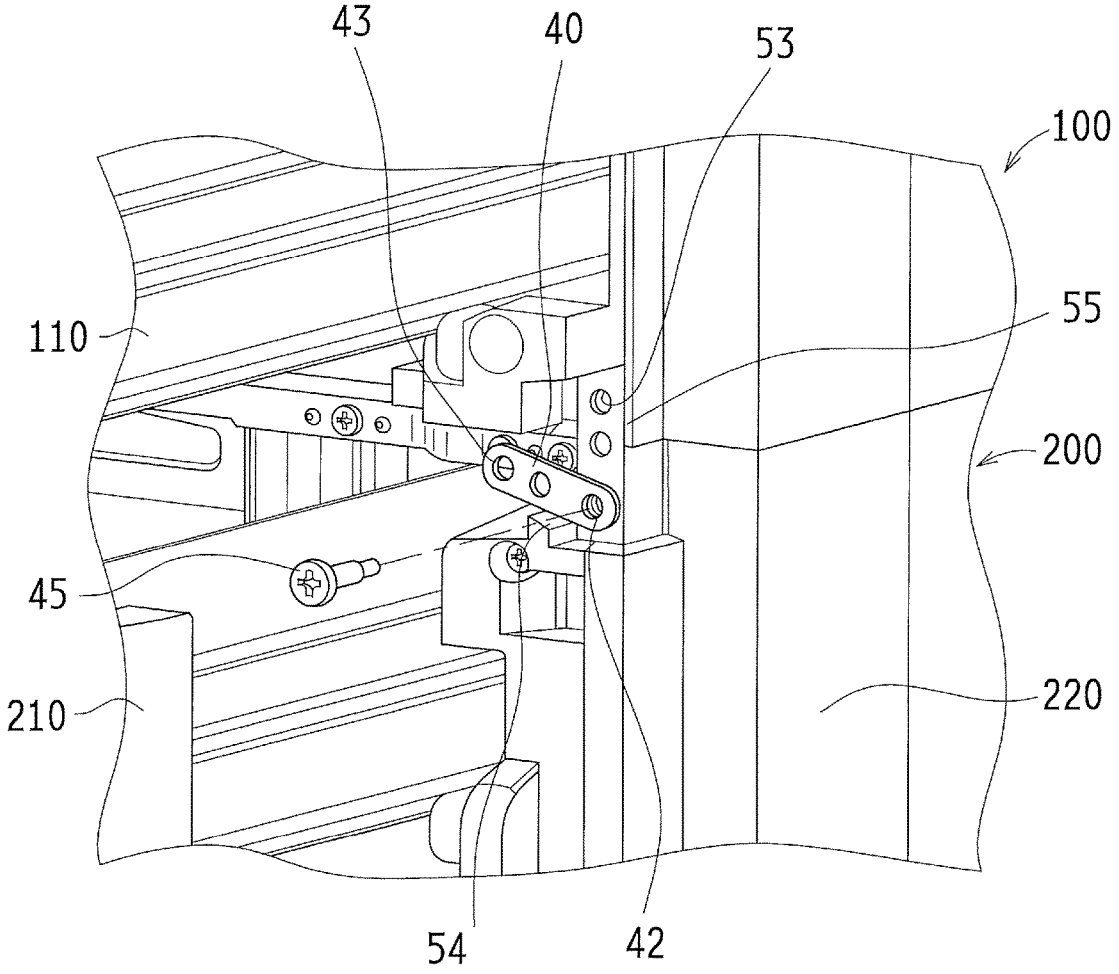
FIG. 10 is a schematic enlarged perspective view illustrating a right one of A portions circled in FIG. 1, in a state where a paper feed cassette on a side of the image forming apparatus and a topmost one of paper feed cassettes on a side of the paper feed desk are pulled out.
Figure 11:
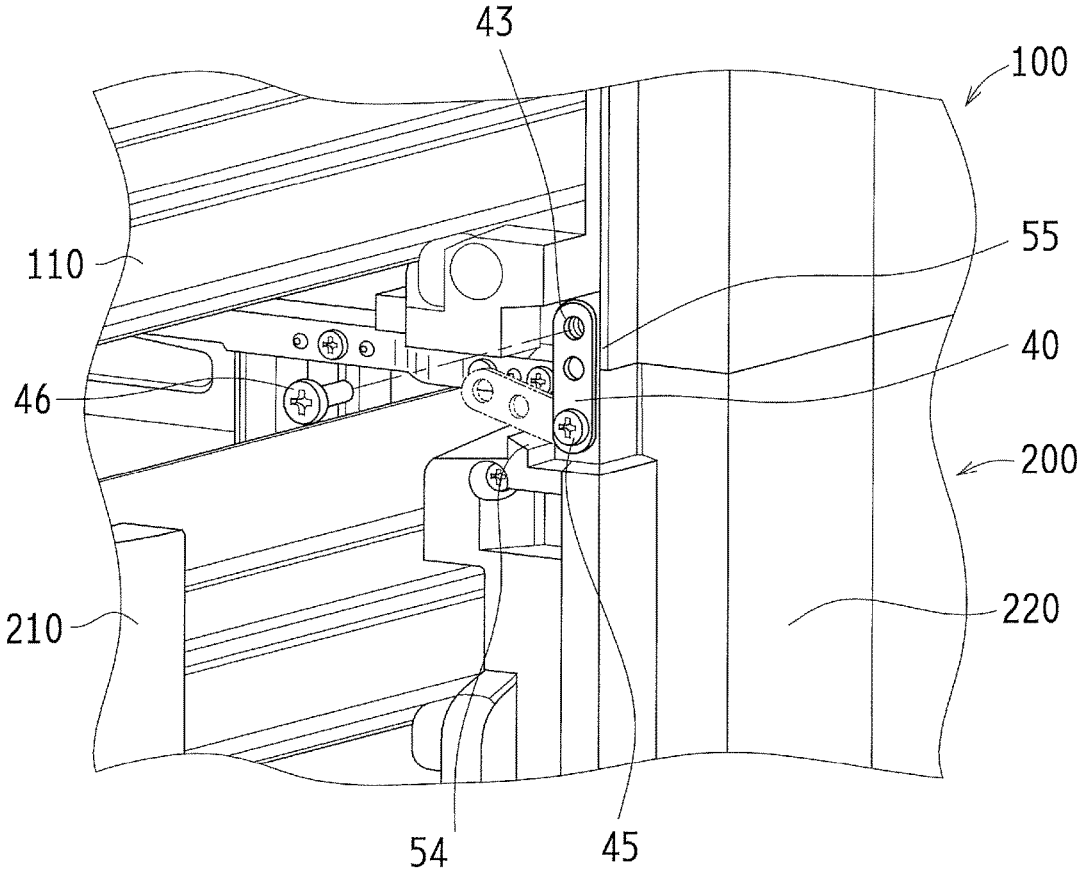
FIG. 11 is a schematic enlarged perspective view illustrating the right one of A portions circled in FIG. 1, in a state where the paper feed cassette on a side of the image forming apparatus and the topmost one of paper feed cassettes on a side of the paper feed desk are pulled out.

FIG. 10 and FIG. 11 are each a schematic enlarged perspective view illustrating the right one of the A portions circled in FIG. 1, in a state where the paper feed cassette 110 on a side of the image forming unit 100 and the topmost one of the paper feed cassettes 210 on a side of the paper feed desk 200 are pulled out.

The second connecting fixing member 40 is formed by punching a fulcrum hole 42 and a fastening hole 43 through a plate portion 41 having a plate shape, and has an approximately I shaped outer shape. For example, the second connecting fixing member 40 is preferably made of a metal material, and may be made of a material other than metal as long as desired strength and workability can be ensured.

The fulcrum hole 42 is a hole used for attaching the paper feed desk 200 to the second connecting fixing member 40 with a shoulder screw 45. With the second connecting fixing member 40 attached by using the shoulder screw 45 for a screw hole (not illustrated) formed at a corresponding position of the paper feed desk 200, the second connecting fixing member 40 is attached to the paper feed desk 200 in such a manner as to be rotatable about the shoulder screw 45.

The fastening hole 43 is a hole used for fixing the second connecting fixing member 40 by using a fixing screw 46 for a fixing hole 53 formed on the image forming unit 100. As illustrated in FIG. 10, in the state where the image forming unit 100 is accurately positioned and placed on the paper feed desk 200, the second connecting fixing member 40 has rotated and thus the fastening hole 43 has moved to the engagement position corresponding to the fixing hole 53 as illustrated in FIG. 11.

The fixing hole 53 is a hole formed on the front surface of the image forming unit 100 in the state where the paper feed cassette 110 is pulled out, and has an inner portion provided with a screw thread. The fixing hole 53 is formed at a position that is overlapped by the fastening hole 43 of the second connecting fixing member 40 as a result of rotating the second connecting fixing member 40 in the state where the image forming unit 100 is mounted on the paper feed desk 200.

Stoppers 54 and 55 are portions of a plate forming the front surface of the desk casing 220 that stand toward the front side, and have a height long enough to interfere with the second connecting fixing member 40 attached to the front surface. The stopper 54 interferes with the second connecting fixing member 40 in a state of being laid due to the weight balance of the second connecting fixing member 40, and thus restricts the rotation of the second connecting fixing member 40. The stopper 55 interferes with the second connecting fixing member 40 that is rotated in a direction to be separated from the stopper 54 to be in an approximately vertical posture to have the fastening hole 43 at the position of the fixing hole 53, and restricts the rotation of the second connecting fixing member 40.

As illustrated in FIG. 10, the second connecting fixing member 40 in the state of being interfered by the stopper 54 so that the rotation thereof is restricted, has an entire portion positioned below the upper surface of the paper feed desk 200.

In this state, the image forming unit 100 is placed on the paper feed desk 200 so that the second connecting fixing member 40 is rotated in the direction of separating from the stopper 54 to have the fastening hole 43 positioned at the fixing hole 53, whereby the approximately vertical posture of the second connecting fixing member 40 is achieved as illustrated in FIG. 11. In this state, the fixing screw 46 is screwed into the fixing hole 53 through the fastening hole 43, whereby the second connecting fixing member 40 is fixed to the front surface of the image forming unit 100. The second connecting fixing member 40 is in the approximately vertical posture with the fastening hole 43 overlapping with the fixing hole 53, and thus the operator can perform an operation with the fixing screw 46 and a tool in his or her hands without holding the second connecting fixing member 40, whereby higher workability can be achieved. Then, when the paper feed cassettes 110 and 210 that have been pulled out are closed, the second connecting fixing member 40 is covered (concealed).

As the connecting fixing members provided at two left and right portions on the front surface of the desk casing 220, the connecting fixing member 10 provided to the side surface of the desk casing 220 may be used instead of the second connecting fixing member 40. Thus, the connection structure that is the same as that on the side surface may be established.

As described above, in the image forming apparatus according to the first embodiment, the paper feed desk 200 and the image forming unit 100 can be connected and fixed to each other with a simple structure. Furthermore, the connecting and fixing can be achieved with higher workability.

Second Embodiment

A second embodiment of the present invention is described below in detail with reference to the drawings. The second embodiment is only different from the first embodiment in the outer shape of the connecting fixing member, and redundant description is omitted.

Figure 12:
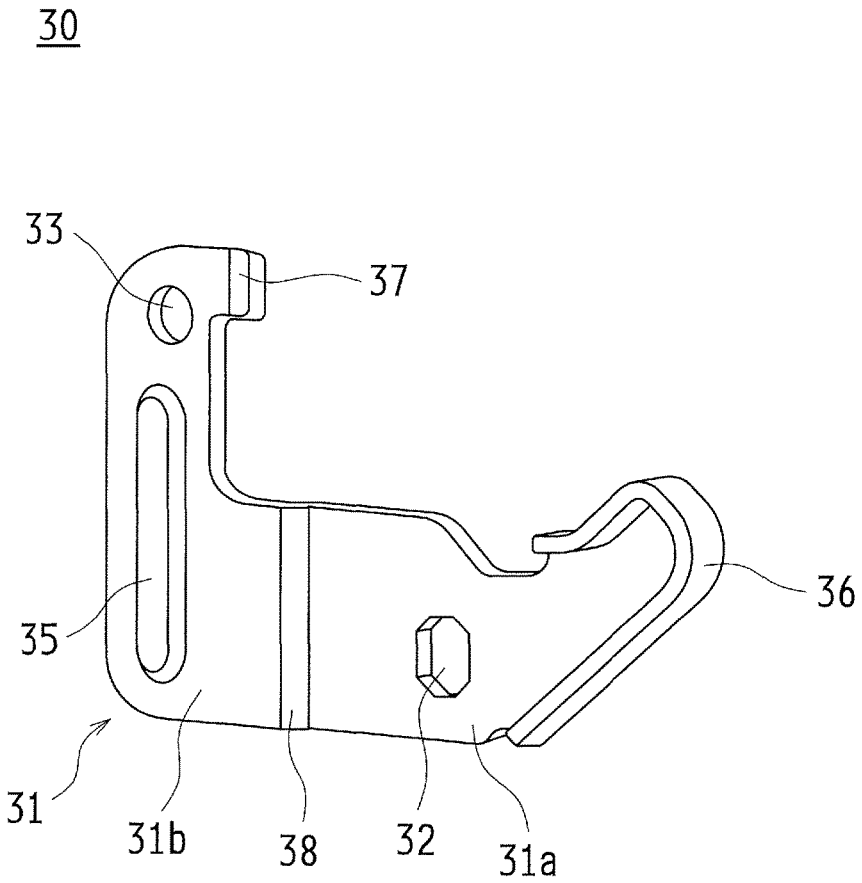
FIG. 12 is a schematic perspective view illustrating a connecting fixing member according to a second embodiment.

FIG. 12 is a schematic perspective view illustrating a connecting fixing member 30 according to the second embodiment. The connecting fixing member 30 is formed by punching a fulcrum hole 32, a fastening hole 33, and a balance adjustment hole 35 through a plate portion 31 having an approximately flat plate shape, and by forming a contact portion 36, a guide portion 37, and a step portion 38 by bending the plate portion 31. With the step portion 38 formed in the plate portion 31, a level difference is provided between an attachment surface 31*a* and a separated surface 31*b*. For example, the connecting fixing member 30 is preferably made of a metal material, and may be made of a material other than metal as long as desired strength and workability can be ensured.

The second embodiment is different from the first embodiment in that the connecting fixing member 30 has an approximately L shaped outer shape, and that no balance adjustment hole 35 is formed on the attachment surface 31*a*. Due to the difference in the outer shape, the relative positions of the fulcrum hole 32, the fastening hole 33, the balance adjustment hole 35, the contact portion 36, the guide portion 37, and the step portion 38 are different from those in the first embodiment.

The outer shape of the connecting fixing member 30, and the relative positions and the number of the fulcrum hole 32, the fastening hole 33, the balance adjustment hole 35, the contact portion 36, the guide portion 37, and the step portion 38 are designed in such a manner as to achieve the desired arrangement of the connecting fixing member 30 in the state where the image forming unit 100 is not mounted on the paper feed desk 200.

The image forming unit 100 can be placed on the paper feed desk 200 in the second embodiment featuring the different outer shape of the connecting fixing member 30 through the same operation. This means that in the image forming apparatus including the connecting fixing member 30 according to the second embodiment, the paper feed desk 200 and the image forming unit 100 can be connected and fixed to each other with a simple structure. Furthermore, the connecting and fixing can be achieved with higher workability.

Third Embodiment

A third embodiment of the present invention is described below in detail with reference to the drawings. The third embodiment is different from the first embodiment in the configuration of the connecting fixing member. More specifically, the connecting fixing member 10 according to the first embodiment has the fixing structure in which the fixing screw 24 is screwed into the fixing hole 23 through the fastening hole 13 after the image forming unit 100 is placed on the paper feed desk 200. In a structure according to the third embodiment, when the image forming unit 100 is placed on the paper feed desk 200, the connecting fixing member is automatically locked to the image forming unit 100. It is to be noted that the locking is not about achieving the completely engaged and fixed state, but is about a structure of preventing the detachment.

Figure 13:
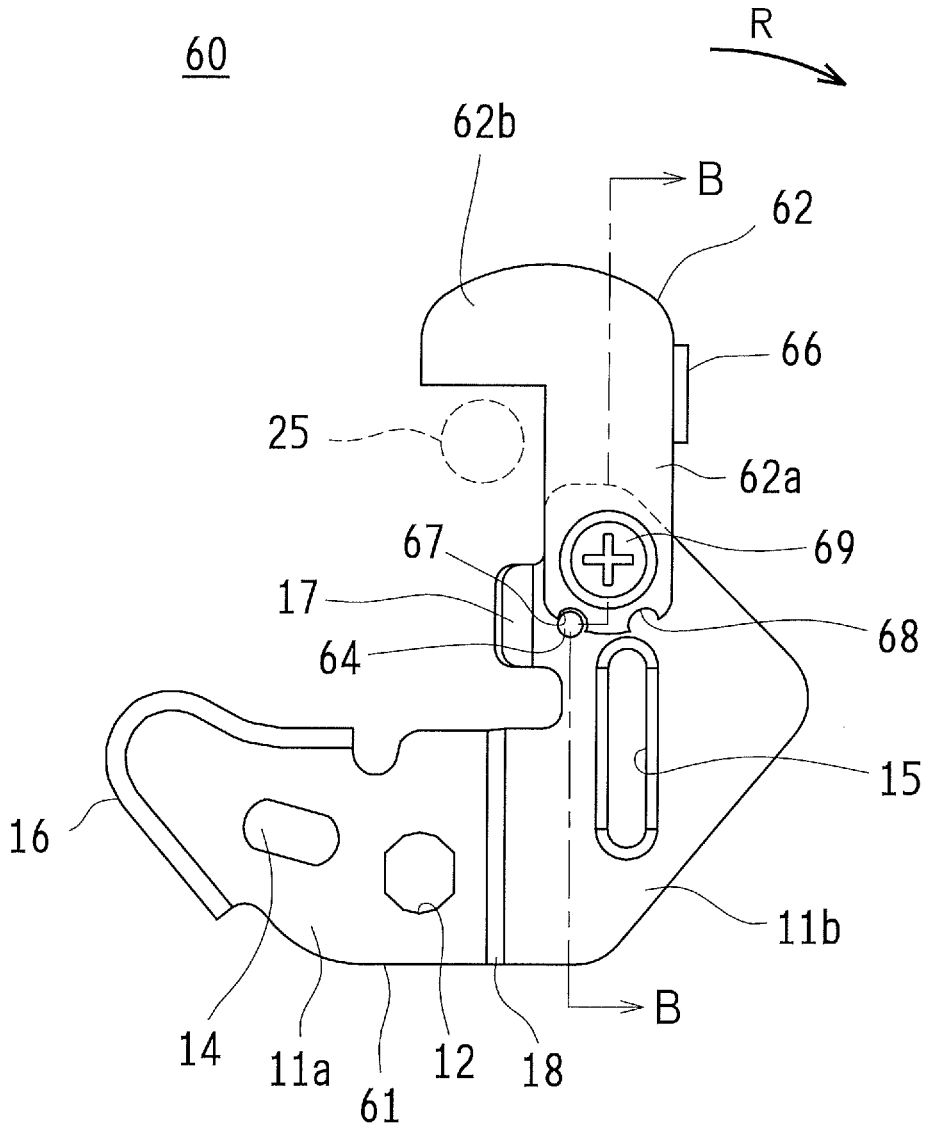
FIG. 13 is a schematic front view illustrating a connecting fixing member according to a third embodiment.
Figure 14:
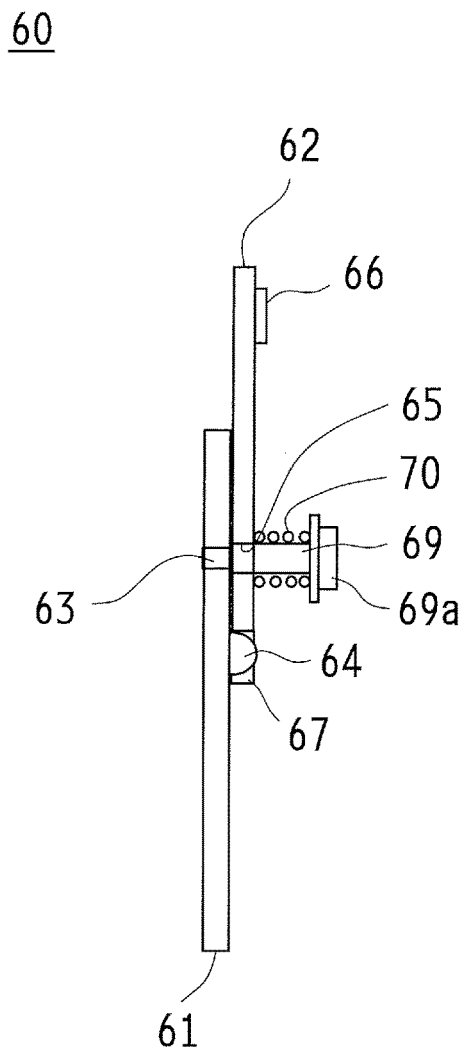
FIG. 14 is a schematic cross-sectional view taken along a line B-B in FIG. 13.
Figure 15:
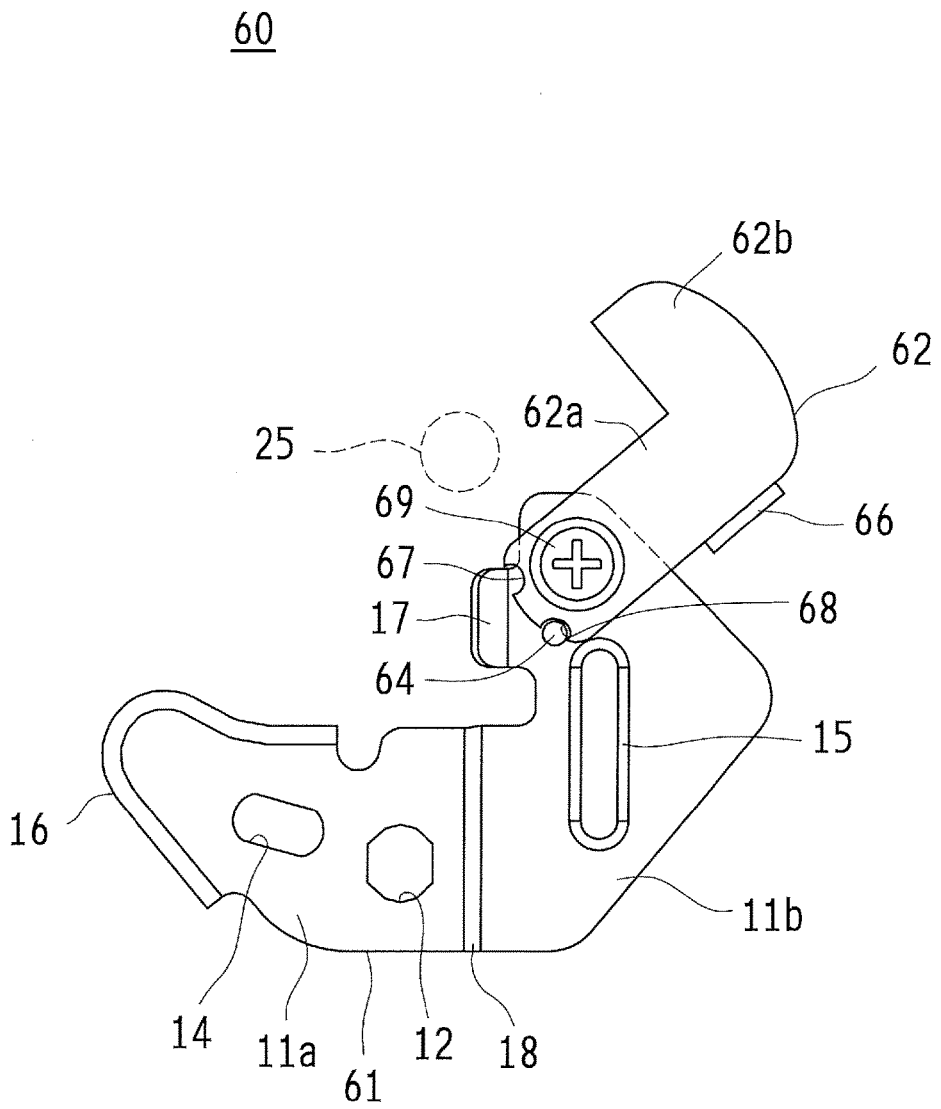
FIG. 15 is a schematic front view illustrating the connecting fixing member according to the third embodiment.

FIG. 13 and FIG. 15 are each a schematic front view of a connecting fixing member 60 according to the third embodiment. FIG. 14 is a schematic cross-sectional view taken along a line B-B in FIG. 13.

The connecting fixing member 60 according to the third embodiment includes: a main body part 61 that is rotatably attached to the paper feed desk 200; and a connection portion 62 rotatably disposed on the main body part 61.

The main body part 61 has approximately the same configuration as the plate portion 11 of the connecting fixing member 10 according to the first embodiment illustrated in FIG. 3. Thus, the main body part 61 is described with the components that are the same as those in the plate portion 11 of the connecting fixing member 10 according to the first embodiment denoted with the same reference numerals and the description thereof omitted.

More specifically, the main body part 61 includes the separated surface 11*b*, the attachment surface 11*a*, the fulcrum hole 12, the balance adjustment holes 14 and 15, the contact portion 16, the guide portion 17, and the step portion 18, but does not include the fastening hole 13. The balance adjustment holes 14 and 15 and the like may also be omitted because the connection portion 62 is provided.

The main body part 61 includes a fixing hole 63 (see FIG. 14) that has a screw thread formed thereon and formed at a position of the fastening hole 13. A locking protrusion portion 64 is provided around the fixing hole 63. The fixing hole 63 is a hole for attaching the connection portion 62 on the side surface of the main body part 61 with a shoulder screw. The locking protrusion portion 64 serves as a restricting portion that restricts the rotation of the connection portion 62.

The connection portion 62 is formed by punching a fulcrum hole 65 (see FIG. 14) through a plate portion having an approximately flat plate shape and by forming an operated portion 66 by bending the plate portion, and has an approximately hook shaped outer shape (approximately upside down L shape). For example, the connection portion 62 is preferably made of a metal material, and may be made of a material other than metal as long as desired strength and workability can be ensured.

More specifically, the connection portion 62 includes: a rotatable piece 62*a* having the fulcrum hole 65 formed on one end portion (base end portion) side; and a connection piece (hereinafter, referred to as a connection lever) 62*b* laterally extending from the other end portion (tip portion) side of the rotatable piece 62*a*. The operated portion 66 is formed by bending an edge portion of the rotatable piece 62*a* on the other end portion side and on a side opposite to the connection lever 62*b*. Locking recessed portions 67 and 68 each in a form of a notch are formed at two positions in a circumference edge portion around the fulcrum hole 65, on the one end portion side of the rotatable piece 62*a*. The rotation of the connection portion 62 is restricted when one of the locking recessed portions 67 and 68 engages with the locking protrusion portion 64 of the main body part 61.

The connection portion 62 is attached with a shoulder screw 69 used for the fixing hole 63 formed in the main body part 61. Thus, the connection portion 62 is attached to the main body part 61 in such a manner as to be rotatable about the shoulder screw 69. As illustrated in FIG. 14, the shoulder screw 69 is provided with a coil spring 70 that is loosely fit to a shaft portion between the connection portion 62 and a head portion 69*a* of the shoulder screw 69, while being in a compressed state. The coil spring 70 constantly biases the connection portion 62 toward the main body part 61. Thus, the connection portion 62 is configured to be capable of slightly moving, against the compressive force of the coil spring 70, in a direction toward the head portion 69*a* of the shoulder screw 69.

The connection portion 62 in a normal state illustrated in FIG. 13 and FIG. 14 is in a state of where the locking recessed portion 67 is engaged with the locking protrusion portion 64. This state corresponds to a state where the connection portion 62 is at a connection position as described later. When the operated portion 66 is operated by a finger in this state so that the connection portion 62 rotates in a direction indicated by an arrow R in FIG. 13, the connection portion 62 rotates to be in a state illustrated in FIG. 15, and the rotation is restricted once a state where the locking recessed portion 68 is engaged with the locking protrusion portion 64 is achieved. This state corresponds to a state where the connection portion 62 is at a release position as described later. When the connection portion 62 slightly moves in the direction toward the head portion 69*a* of the shoulder screw 69 against the compressive force of the coil spring 70 to climb over the locking protrusion portion 64 and the locking recessed portion 68 rotates to the position of the locking protrusion portion 64, the connection portion 62 moves in a direction to be in contact with the main body part 61 due to the pressing force of the coil spring 70. Then, the locking recessed portion 68 fits and engages with the locking protrusion portion 64. The rotation from the state (release position) illustrated in FIG. 15 to the state (connection position) illustrated in FIG. 13 can be achieved through an operation in a reversed manner from that described above.

Figure 16:
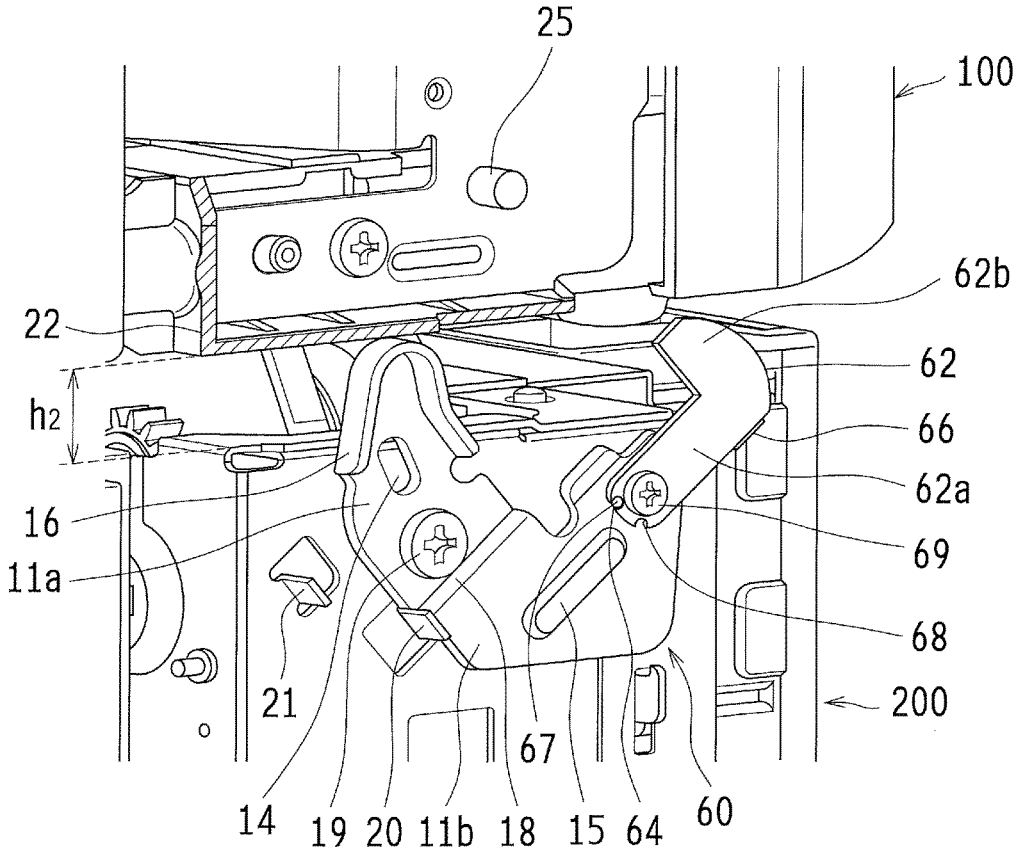
FIG. 16 is a schematic enlarged perspective view illustrating a state where the image forming unit is positioned on the paper feed desk, representing a state before the image forming unit is mounted on the paper feed desk.

FIG. 16 is a schematic enlarged perspective view illustrating a state where the image forming unit 100 is positioned on the paper feed desk 200, representing a state before the image forming unit 100 is mounted on the paper feed desk 200. The connecting fixing member 60 is attached by using the shoulder screw 19 with the fulcrum hole 12 aligned with a screw hole (not illustrated) disposed around the upper portion of the side surface of the paper feed desk 200. At this point, the main body part 61 and the connection portion 62 of the connecting fixing member 60 are in the state illustrated in FIG. 13.

The paper feed desk 200 has the side surface provided with the stoppers 20 and 21. The interference portion 22 is provided to the bottom surface of the image forming unit 100. A connection pin (connected portion) 25 is provided to a portion near the lower portion of the side surface of the image forming unit 100.

The stoppers 20 and 21 and the interference portion 22 are the same as those illustrated in FIG. 4 to FIG. 6 in the first embodiment, and the description thereof will be omitted. Although not elaborated in FIG. 16, the positioning pin 201 that is the same as that illustrated in FIG. 1 and FIG. 2 in the first embodiment is used.

The connection pin 25 is a pin provided to the side surface of the image forming unit 100. The connection pin 25 is formed at such a position that the connection lever 62*b* of the connecting fixing member 60 faces the upper portion of the connection pin 25 when the image forming unit 100 is mounted on the paper feed desk 200. In this case, the connection lever 62*b* and the connection pin 25 may be at such relative positions to be in contact with each other, but do not have to be contact with each other and may be arranged with a slight gap in between. More specifically, the connection pin 25 and the connection lever 62*b* may be in any arrangement as long as the connection pin 25 comes into contact with the connection lever 62*b* so as not to be lifted any further by an attempt to lift the image forming unit 100 from the paper feed desk 200.

As illustrated in FIG. 16, the contact portion 16 comes into contact with the interference portion 22, when the distance h2 is achieved between the bottom surface of the image forming unit 100 and the upper surface of the paper feed desk 200. When the image forming unit 100 is lowered after the distance h2 is achieved, the contact portion 16 is pressed down in the direction not restricted by the stopper 20. Thus, the attachment surface 11*a* of the connecting fixing member 60 rotates downward about the shoulder screw 19, and the separated surface 11*b* of the connecting fixing member 60 starts rotating upward together with the connection portion 62.

The distance between the bottom surface of the image forming unit 100 and the upper surface of the paper feed desk 200 at the point when the contact portion 16 comes into contact with the interference portion 22 is approximately the same as the height h2 of the portion of the contact portion 16 and the connection lever 62*b* of the connection portion 62 protruding beyond the upper surface of the paper feed desk 200. The height h1 of the lower portion 201*a* of the positioning pin 201 and the protruding height h2 of the contact portion 16 and the connection lever 62*b* are preferably set in such a manner that h1≥h2 holds true, so that when the image forming unit 100 is positioned and lowered, the contact portion 16 comes into contact with the interference portion 22 and the connection portion 62 starts rotating, after the lower portion 201*a* of the positioning pin 201 reaches the positioning hole.

The diameters of the lower portion 201*a* of the positioning pin 201 and the positioning hole are set to be approximately the same. Thus, when h1≥h2 holds true, the connecting fixing member 60 starts rotating with the contact portion 16 pressed down, after the image forming unit 100 is accurately positioned. This means that the connecting fixing member 60 does not rotate until the image forming unit 100 is accurately positioned. All things considered, the connecting fixing member 60 is prevented from rotating, whereby the connection portion 62 of the connecting fixing member 60 is prevented from colliding with the bottom surface of the image forming unit 100.

Figure 17:
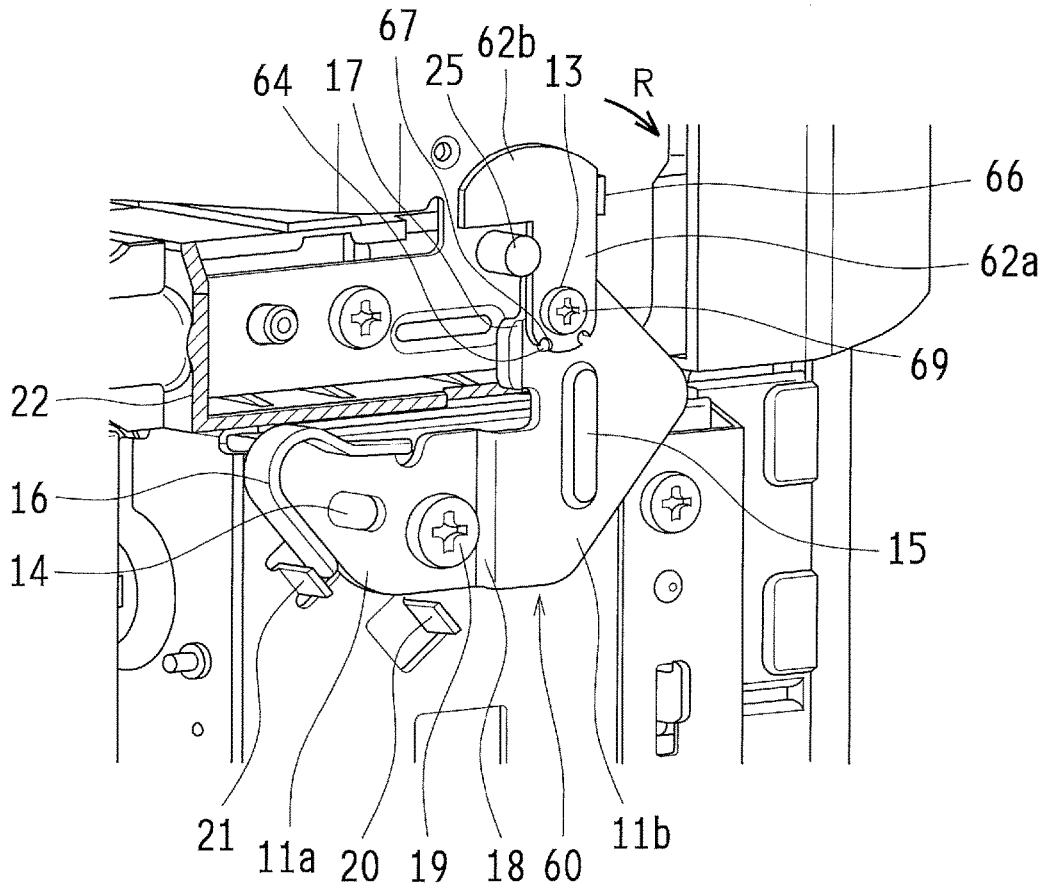
FIG. 17 is a schematic enlarged perspective view illustrating a state where the image forming unit is placed on the paper feed desk.

FIG. 17 is a schematic enlarged perspective view illustrating a state where the image forming unit 100 is placed on the paper feed desk 200. In the state where the image forming unit 100 is placed on the paper feed desk 200, the contact portion 16 has been pressed down by the interference portion 22, and thus the attachment surface 11*a* has been rotated to be below the upper surface of the paper feed desk 200. In this process, the connecting fixing member 60 is rotated about the fulcrum hole 12 and the shoulder screw 19, whereby the connection portion 62 is rotated upward.

As illustrated in FIG. 17, in the state where the image forming unit 100 is placed on the paper feed desk 200, the contact portion 16 has been pressed down by the interference portion 22, and thus the connecting fixing member 60 has been rotated and the connection lever 62*b* of the connection portion 62 has moved to the upper portion (i.e., the connection position) of the connection pin 25. Thus, the connection lever 62*b* and the connection pin 25 face each other in an upper and lower direction. Thus, when the image forming unit 100 is lifted upward from the paper feed desk 200, the connection pin 25 is locked by (connected with) the connection lever 62*b* to be prevented from being lifted any further (detaching is prevented).

When the operated portion 66 is operated in a direction R in the figure in the state where the connection lever 62*b* is at the connection position as illustrated in FIG. 17 so that the connection portion 62 rotated, the connection portion 62 rotates to be in the state (release position) illustrated in FIG. 15. Thus, the connection lever 62*b* moves away from the portion above the connection pin 25. Thus, when the image forming unit 100 is lifted upward in this state, the image forming unit 100 can be easily detached from the paper feed desk 200. The operation on the operated portion 66 described above can be performed through the cover opening portion 122 of the casing 120 by removing the opening/closing cover 121 as illustrated in FIG. 8.

When the image forming unit 100 is lifted from the paper feed desk 200 in the state illustrated in FIG. 17, the connecting fixing member 60 rotates to restore the state illustrated in FIG. 16 due to the weight balance.

In the third embodiment, the image forming unit 100 only needs to be placed on the paper feed desk 200, and no operation of fixing the connecting fixing member with the fixing screw is required, whereby higher workability can be achieved.

Fourth Embodiment

A fourth embodiment of the present invention is described below. In the first embodiment and the third embodiment, the examples are described where the connecting fixing member 10/60 is rotatably attached to the side surface of the paper feed desk 200. However, the apparatus to which the connecting fixing member is attached in the present invention is not limited. In the fourth embodiment, an example is described where the connecting fixing member 10/60 is attached to the side surface the image forming unit 100. In this example, a structure obtained by turning the structure described in the first embodiment with reference to FIGS. 4 to 6 upside down, and the redundant description and illustration are omitted.

In the fourth embodiment, the connecting fixing member 10/60 is rotatably attached by using the shoulder screw 19, with the fulcrum hole 12 aligned with the screw hole disposed near the lower portion of the side surface of the image forming unit 100. The image forming unit 100 has the side surface provided with the stoppers 20 and 21. The interference portion 22 is provided to the upper surface of the paper feed desk 200. The fixing hole 23 is provided to a portion around the upper portion of the side surface of the paper feed desk 200.

The contact portion 16 protrudes beyond the bottom surface of the image forming unit 100, before the image forming unit 100 is placed on the paper feed desk 200. When the image forming unit 100 is positioned and placed on the paper feed desk 200, the interference portion 22 presses the contact portion 16 upward. Thus, the connecting fixing member 10/60 rotates so that the separated surface 11*b* moves downward. Thus, when the connecting fixing member 10 is used, the fastening hole 13 moves to the engagement position to overlap with the fixing hole 23. In this state, the fixing screw 24 is screwed into the fixing hole 23 through the fastening hole 13, whereby the connecting fixing member 10 is fixed to the side surface of the paper feed desk 200. When the connecting fixing member 60 is used, the connection lever 62*b* moves to the connection position to face the connection pin 25. Thus, the contact between the connection pin 25 and the connection lever 62*b* is automatically achieved. It should be noted that the contact is for preventing the detachment as described above, and the connection pin 25 needs not to be in actually in contact with the connection lever 62*b*.

Thus, also in the image forming apparatus according to the fourth embodiment, the paper feed desk 200 and the image forming unit 100 can be connected and fixed to each other with a simple structure. Furthermore, the connecting and fixing can be achieved with higher workability.

The present invention can be implemented in various other forms without departing from the spirit and the main features of the present invention. These embodiments are provided by way of example and are not construed in a limited sense. The scope of the present invention is defined by the appended claims and is not restricted by the specification in any manner. Furthermore, modifications and changes belonging to the equivalents of the claims are within the scope of the present invention.

What is claimed is:

1. An image forming apparatus comprising:

a first device; and a second device stacked on the first device, wherein the first device or the second device includes a connecting fixing member including:

an axis portion that is rotatably provided to one device which is one of the first device and the second device;

a connection portion with which the devices are connected and fixed to each other; and a contact portion that comes into contact with an other device, which is the other one of the first device and the second device, when the first device is connected to the second device, the connection portion and the contact portion concentrically rotate about the axis portion, the contact portion rotates about the axis portion when the contact portion comes into contact with the other device, and the connection portion rotates to a connection position about the axis portion.

2. The image forming apparatus according to claim 1, wherein when the contact portion is in a state of not being in contact with the other device, the contact portion is at a position of protruding in a direction from the one device toward the other device, and the connection portion is at a position of not protruding in the direction from the one device toward the other device.

3. The image forming apparatus according to claim 2, wherein in the connecting fixing member, a step is formed between the contact portion and the connection portion.

4. The image forming apparatus according to claim 1, wherein the connection portion is provided with a hole in which a fastening member is inserted.

5. The image forming apparatus according to claim 1, wherein the connection portion rotates to the connection position so as to be connected to a connected portion provided to the other device.

6. The image forming apparatus according to claim 5, wherein the connecting fixing member includes a main body part, and wherein the connection portion is provided to the main body part in such a manner as to be rotatable in a direction of the rotation between the connection position to be connected with the connected portion and a release position where the connection with the connected portion is released.

7. The image forming apparatus according to claim 6, wherein the connecting fixing member includes a restricting portion with which a position of the connection portion is restricted at the connection position and at the release position.

8. The image forming apparatus according to claim 6, wherein the connection portion includes an operated portion used for causing rotation between the connection position and the release position.

9. The image forming apparatus according to claim 5, wherein the connected portion is a connection pin, and the connection portion is a connection lever to be connected with the connection pin.

10. The image forming apparatus according to claim 1, wherein the first device or the second device includes a second connecting fixing member including a connection portion with which the devices are connected and fixed to each other, and wherein the second connecting fixing member is rotatably provided to the one device that is one of the first device and the second device, and the connection portion rotates to the connection position of the other device when the second connecting fixing member rotates.

11. The image forming apparatus according to claim 1, wherein the one device is the second device, the other device is the first device, and the first device is placed on and connected to the second device.

12. A paper feed device configured to feed paper to an image forming unit mounted on the paper feed device, the paper feed device comprising a connecting fixing member including:

an axis portion that is rotatably provided to the paper feed device;

a connection portion with which the image forming unit is connected and fixed; and a contact portion that comes into contact with the image forming unit when the paper feed device is connected to the image forming unit, wherein the connection portion and the contact portion concentrically rotate about the axis portion, the contact portion rotates about the axis portion when the contact portion comes into contact with the image forming unit, and the connection portion rotates to a connection position of the image forming unit about the axis portion.

* * * * *